US005531161A

United States Patent [19]

Coyle et al.

[11] Patent Number: 5,531,161

[45] Date of Patent: Jul. 2, 1996

[54] GRAVURE COATING FEEDER APPARATUS

[75] Inventors: Dennis J. Coyle, Clifton Park; Barry A. Fitzgerald, Holley, both of N.Y.

[73] Assignee: Eastman Kodak Company, Rochester, N.Y.

[21] Appl. No.: 350,921

[22] Filed: Dec. 7, 1994

[51] Int. Cl.[6] ..... B41F 9/10; B41F 31/07

[52] U.S. Cl. ..... 101/157

[58] Field of Search ..... 101/366, 157, 101/169, 363, 364, 207–210, 148, 350, 351, 365; 118/259, 261, 212

[56] References Cited

U.S. PATENT DOCUMENTS

| | | | |
|---|---|---|---|
| 1,921,953 | 8/1933 | Stephens . | |
| 2,278,138 | 3/1942 | Paardecamp | 101/157 |
| 2,641,220 | 6/1953 | Weber et al. . | |
| 3,339,485 | 9/1967 | Rytterholm . | |
| 3,936,549 | 2/1976 | Kohler et al. . | |
| 4,158,333 | 6/1979 | Navi . | |
| 4,352,670 | 10/1982 | Georgiades . | |
| 4,373,443 | 2/1983 | Matalia et al. . | |
| 4,497,250 | 2/1985 | Dressler | 101/366 |
| 4,625,643 | 12/1986 | Davis | 101/366 |
| 5,031,529 | 7/1991 | Greenwood | 101/366 |
| 5,058,502 | 10/1991 | Kobler | 101/366 X |
| 5,182,989 | 2/1993 | D'Heureuse et al. | 101/363 |
| 5,233,922 | 8/1993 | Stirbis et al. . | |
| 5,272,976 | 12/1993 | Peder | 101/366 |
| 5,325,775 | 7/1994 | Grosshauser et al. | 101/366 |

*Primary Examiner*—J. Reed Fisher
*Attorney, Agent, or Firm*—Clyde E. Bailey, Sr.

[57] ABSTRACT

An apparatus to apply a uniform coating to a gravure cylinder for imprinting upon a second surface, typically a web, is disclosed herein. The apparatus includes a feed bar, which controls the flow of the coating solution, and a supply box, which includes end dams, an overflow port, and a reservoir created by a baffle. With the overflow port and baffles a uniform coating of a composition is achieved without imperfections created by evaporation or foreign matter.

4 Claims, 4 Drawing Sheets

GRAVURE COATING FEEDER APPARATUS

FIELD OF THE INVENTION

The present invention relates to supplying a coating roller with a liquid coating composition. More particularly, the present invention relates to a coating feeder apparatus to uniformly coat a gravure cylinder with a liquid coating composition for delivery to a moving web on a second cylinder.

Background of the Invention

Gravure cylinders are a common means of supplying liquid compositions to webs. U.S. Pat. No. 4,373,443 describes the use of a gravure cylinder to provide ink in newspaper presses. Engraved upon the surface of the gravure cylinder are cells, which retain the liquid composition after being immersed in the reservoir. A doctor blade scrapes excess liquid composition from the surface of the gravure cylinder, such that the cylinder delivers a precise amount of liquid to a second surface upon contact. A number of distinct feed apparatus types are used to coat a gravure cylinder.

One common means of coating a gravure cylinder is a feed pan, similar to U.S. Pat. No. 3,936,549. The pan is constructed to hold a supply of the liquid composition with a means to maintain the liquid level. The gravure cylinder, while partially immersed in the reservoir, rotates to fill the cells and transfer the composition to a web. Drawbacks of the feed pan design include liquid waste due to large holdup volumes and the creation of "flow lines" in the coating. "Flow lines" occur when the gravure cylinder surface initially dips into the liquid composition and contacts a region with impurities. The impurities include air bubbles, globules of concentrated dye and binder, and pieces of partially dried foam. The feed pan design is conducive for the formation of stagnation regions where impurities may form and collect. Experiments with alternative pan designs were unsuccessful in eliminating "flow lines," particularly at high coating speeds.

An additional common means to coat the gravure cylinder is a reverse doctor-pond feed, as seen in U.S. Pat. No. 4,158,333. The pond feed, which may be open or enclosed, is centered at the nine o'clock position with a reverse angled doctor blade at the seven o'clock position. The reverse doctor blade scrapes the surface of the gravure cylinder as the surface exits the reservoir and the doctored cells pass through three quarters of a rotation before reaching the impression nip. The volatile solvents in the liquid composition remaining in the cells evaporate or "dry in" and create a leading edge pattern on the second cylinder or web. Additionally, foam generation on the pond surface may lead to "flow line" problems as with the feed pan method.

Another alternative apparatus to coat the gravure cylinder is an X-hopper coater, which is an extrusion device. A high degree of accuracy and precision are required to position the device relative to the gravure cylinder. The feed applies a thick (2–5 mils) coating to the cylinder at the three o'clock position. The surface remains wetted until reaching the doctor blade at the standard 10 o'clock position. The disadvantage of the design is primarily the cost associated with constructing a precise metering slot and a high pressure metering pump. The design is also inadequate for startup procedures, where the feeder coats the cylinder while the doctor blade and impression nip are disengaged. Under those conditions the excess coating solution would pool and splash at the hopper's lip.

The problems identified and solved by the present invention include an apparatus to uniformly coat a gravure cylinder at high coating speeds without defects from evaporation and impurities. This apparatus reduces waste and costs associated with the gravure coating process.

SUMMARY OF THE INVENTION

The present invention supplies a liquid coating composition to a gravure cylinder for later transferal to a second surface. A supply box, comprised of end dams, one or more baffles, and a composition delivery means, creates a reservoir for the liquid coating composition. A feed bar on a mounting plate with a pivot creates a metering gap longitudinally along the surface of the gravure cylinder. The reservoir supplies the metering slot of the feed bar with the composition to be coated. Overflow ports may be present in the ends dams to control liquid level and impurities.

The present invention has several advantages over the prior art. The invention utilizes one or more baffles to reduce turbulence and the formation of bubbles, foam, and uneven flow patterns, which may cause "flow lines" and other coating defects. Overflow ports also reduce the probability that bubbles and foam may lead to coating defects. The gravure cylinder's cells are wetted uniformly, because the liquid composition in the reservoir remains at a constant level across the breadth of the baffle. The apparatus wets the cells of the gravure cylinder immediately after coating the web at the impression nip and thereby lessens the effects of evaporation or "drying-in" of the cells. The controlled excess coating delivered to the cells results in greatly reduced splash from the doctor blade and a reduction in bubble creation prior to the impression nip.

The metering slot provides an inexpensive means to regulate the coating thickness on the gravure cylinder. A thinner coating allows a reduction in the volume of liquid composition required for the operation of the coater and thereby reduces wasted liquid composition. However, the coating is thick enough to prevent evaporation from the cells prior to reaching the doctor blade. The apparatus is a more robust process, since it limits evaporation and thereby stabilizes the effect of evaporative cooling upon the gravure cylinder.

For a better understanding of the present invention together with other objects, advantages and capabilities thereof, reference is made to the following description and appended claims in connection with the above described drawings.

DETAILED DESCRIPTION OF THE INVENTION

Figure 1:
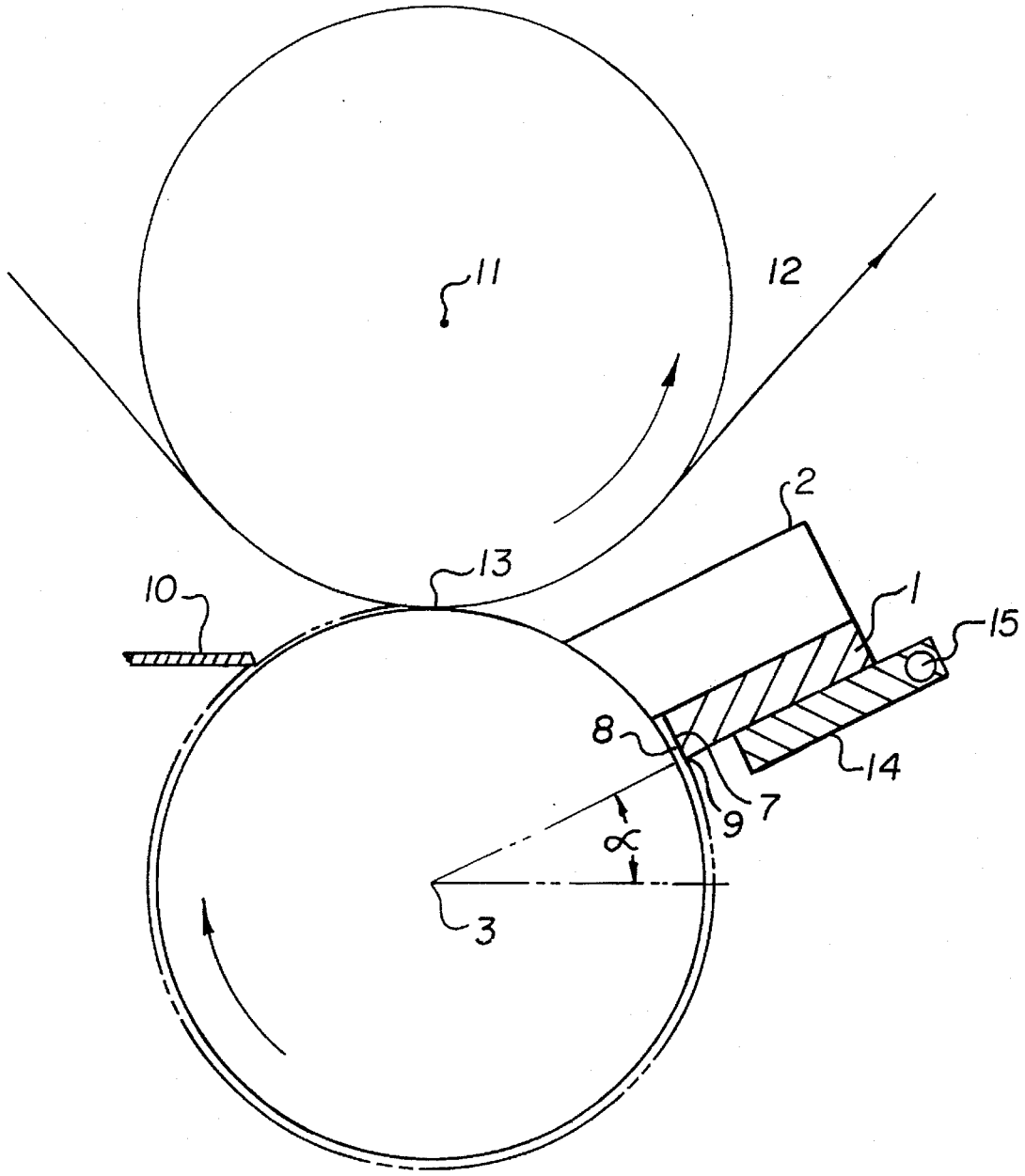
FIG. 1 is a general view of the gravure cylinder with one coating feeder apparatus

FIG. 1 shows a general side view of the gravure cylinder and the coating feeder apparatus of the present invention. A supply box 2 and a feed bar 1 are supported by a mounting plate 14, which is on a pivot 15. The mounting plate 14 and pivot 15 allow the feed bar 1 to create a metering slot 8 With a gravure cylinder 3 at an angle α. The angle α is between −80 and +80 degrees from a horizontal plane; preferably between −10 and +30 degrees, and most preferably at +20 degrees. The feed bar 1 has a straight knife edge 7, which results in a converging character for the metering slot 8. The narrowest point of the metering slot 8 is the exit lip 9.

Figure 2:
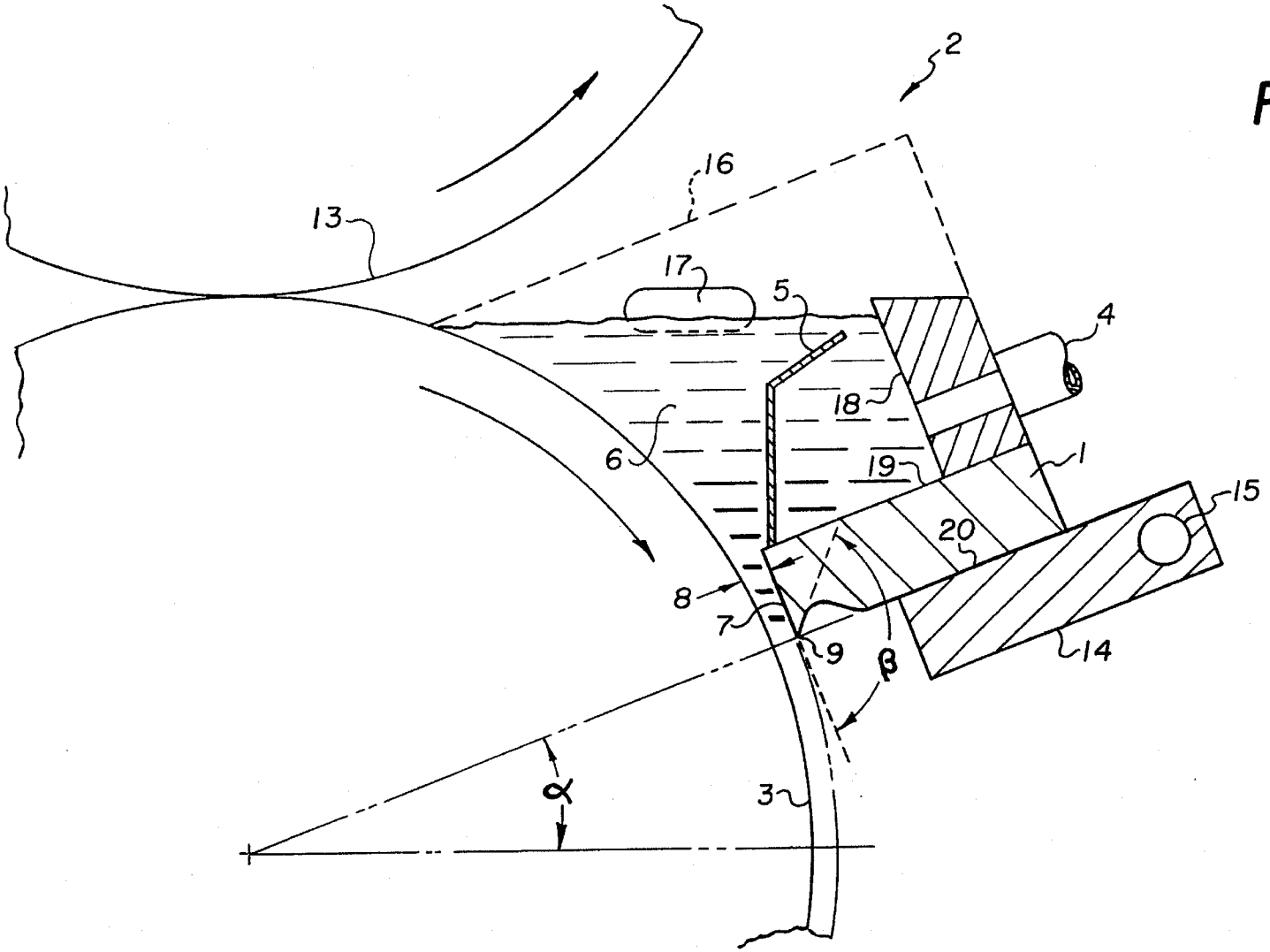
FIG. 2 is a detailed sectional view of the coating feeder apparatus.

FIG. 2 is a detailed side view of the coating feeder apparatus. The supply box 2 is formed by two end dams 6, an upper wall 19 and a back wall 18 of the feed bar 1, and the gravure cylinders 3. A feed pipe 4 delivers a liquid coating composition to the supply box 2. When the region behind baffle 5 overflows, the composition fills a reservoir 6 between the baffle 5 and the gravure cylinder 3 and above the metering slot 8. The reservoir 6 is preferably ½–3 inches deep, which is a function of the height of the baffle 5. The baffle 5 in the supply box 2 impedes the formation of turbulent eddies within the reservoir 6 by isolating the flow from the feed pipe 4 from the reservoir 6.

Figure 3:
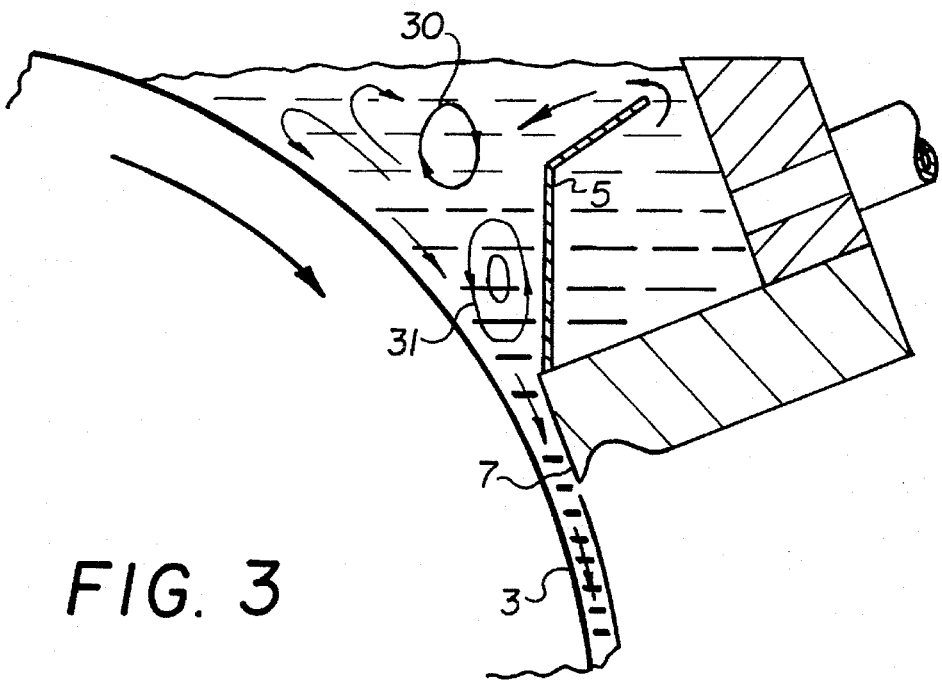
FIG. 3 shows a flow visualization of the reservoir at a high Reynolds Number condition.
Figure 4:
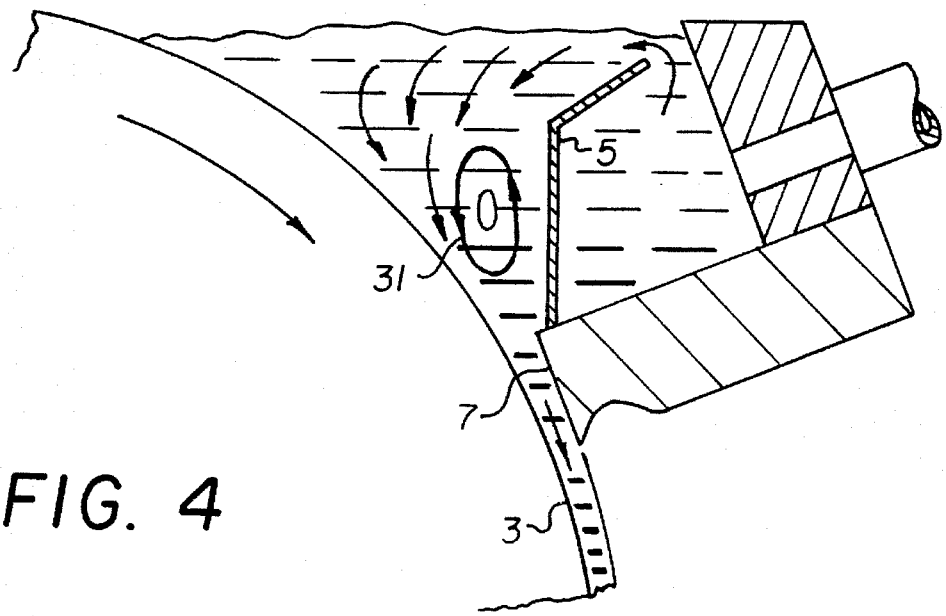
FIG. 4 shows a flow visualization of the reservoir at a low Reynolds Number condition.

The reservoir 6 in the supply box 2 acts as a buffer against feed non-uniformity and process disturbances. It is small enough to impede wave formation and turbulence. At low coating speeds, the flow within the reservoir 6 is laminar and a single stable vortex 31 is present. At high coating speeds the Reynolds Number of the flow reaches the turbulent regime and the vortex eddies 30,31 become unstable. Operation of the apparatus is preferably at coating speeds below the transition point from laminar to turbulent flow as evaluated for the particular reservoir 6 configuration. FIG. 3 illustrates the flow patterns within the reservoir 6 at high Reynolds Numbers. FIG. 4 illustrates the flow patterns with the reservoir at high Reynolds Numbers. At high Reynolds Numbers the inertial forces are greater than the viscous forces and surface conditions generate foam, which collect at stagnation points.

An overflow port 17 is in one or both of the end dams 16 of the supply box 2. The overflow port 17 may also be located in the back wall of the feed bar 1. Excess liquid composition in the reservoir 6 recirculates to the feed slot 4 through the overflow port 17, thus preserving the composition level. The overflow port 17 also removes bubbles and other matter which may create "flow lines."

As the gravure cylinder 3 rotates, the liquid composition is drawn from the reservoir 6 in the supply box 2 into the metering slot 8. The metering slot 8 is preferably ¼–3¾ centimeters long and 0.05–0.4 millimeters wide; more preferably 2 centimeters long and 0.05–0.15 millimeters wide. The thickness of the coating is uniform across the length and breadth of the metering slot 8 and proportional to the width of the metering slot 8. Coating thickness is independent of coating speed and viscosity of the liquid composition. The exit lip 9 of the feed bar 1 is under-cut to a second angle β to deter the wetting of the lower wall 20 of the feed bar 1 and thereby provide a pinning point for the coating meniscus. The angle β is preferably 40–160 degrees; most preferable 90–145 degrees.

After the feed bar 1 coats the cells and the surface of the gravure cylinder 3 with the liquid composition in the reservoir 6, the coating is trimmed by a doctor blade 10 (shown in FIG. 1) immediately before reaching an impression nip 13. At the impression nip 13 the cells of the gravure cylinder 3 coat a web 12 of a second cylinder 11.

In an alternate embodiment, the front edge 7 of the feed bar 1 is profiled to match the curvature of the gravure cylinder 3. The metering slot 8 has a uniform width dimension along it entire length. As compared to the converging gap, the parallel gap is easier to setup and yields a thinner film for a given minimum gap width distance. A thinner film means less power to run the supply pump and less liquid waste.

EXAMPLE

Figure 5:
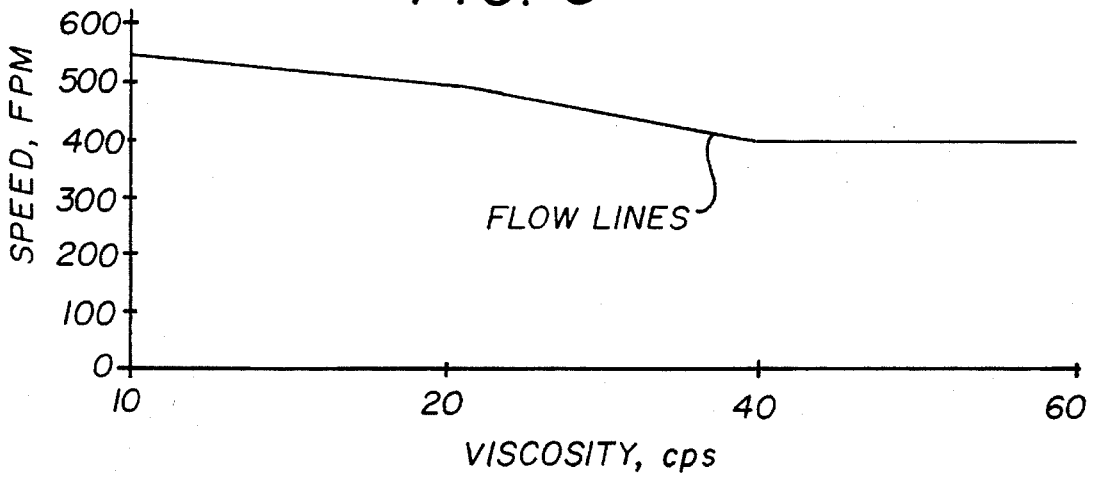
FIG. 5 shows pond stability limit for feed pan apparatus without the metering slot of the present invention.

FIG. 5 shows the pond stability limit in terms of maximum speed versus viscosity using donor dye solutions for various standard pan sizes and shapes without the metering slot of the present invention. Flow lines occur below the line. A narrower pond and higher viscosity allow for greater coating speed. The ultimate limit on speed and viscosity is catastrophic air entrainment which occurs above the line.

Figure 6:
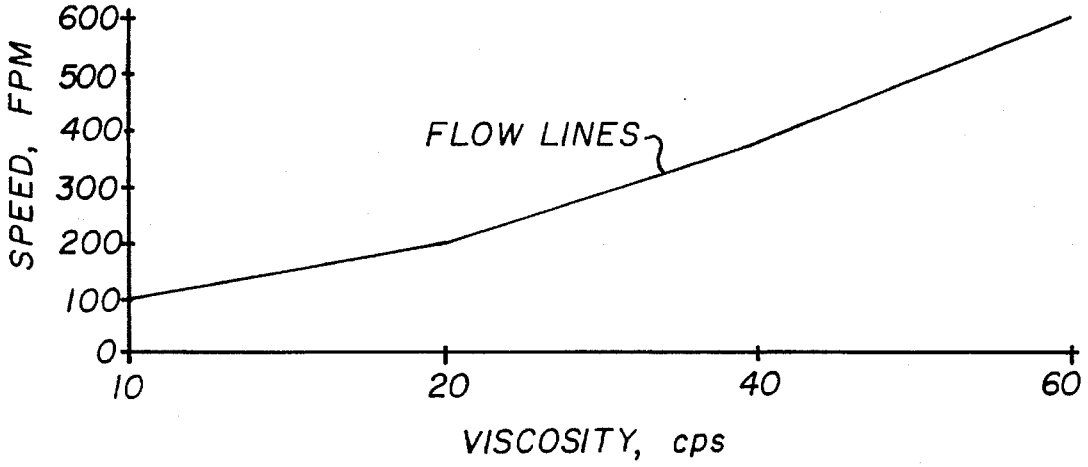
FIG. 6 shows pond stability limit for feed pan apparatus with the meter slot of the present invention.

FIG. 6 shows the pond stability limit in terms of maximum speed versus viscosity using various standard pan sizes and shapes including the metering slot of the present invention. Flow lines occur above the line. A comparison of FIGS. 5 and 6 reveals that the present invention allows for greater coating latitude without the risk of flow lines.

While there has been shown and described what are at present considered the preferred embodiments of the invention, it will be obvious to those skilled in the art that various changes, alterations and modifications may be made therein without departing from the scope of the invention as defined by the following claims.

What is claimed is:

1. A coating feeder for supplying liquid coating composition to a gravure cylinder comprising:

a supply box having a fully opened top portion, opposite end walls adjoining a back wall, said opened top portion extending from said back wall to a circumferential portion of said gravure cylinder, said opposite ends surrounding said fully opened top portion, a feed bar forming the base of said box, a baffle mounted on said base and extending upwardly into the box, and a delivery means for supplying coating composition to the supply box;

said feed bar being disposed longitudinally adjacent the gravure cylinder, said baffle being fixed at one end to said feed bar, wherein a metering slot is formed between a surface of the coating roll and a front surface of the feed bar, the feed bar having an upper surface forming a bottom wall of the supply box;

at least one overflow slot positioned on at least one of said end walls, said overflow slot and said baffle cooperating to control the liquid coating composition level in said supply box;

a doctor blade to trim the coating composition, which is delivered from the supply box to the surface of the gravure cylinder through the metering slot.

2. The coating feeder according to claim 1 wherein the delivery means comprises a feed slot through the feed bar.

3. The coating feeder according to claim 1 wherein the front surface of the feed bar has a straight edge joining opposed side edges, one side edge having a contoured cut-out, said straight edge being configured to converge upon the gravure cylinder.

4. The coating feeder according to claim 3 wherein the front surface of the feed bar has a curvature which matches a curvature of the gravure cylinder.

* * * * *